US011291315B2

(12) United States Patent
Santarelli

(10) Patent No.: US 11,291,315 B2
(45) Date of Patent: Apr. 5, 2022

(54) GREETING CARD DISPLAYER

(71) Applicant: American Greetings Corporation, Cleveland, OH (US)

(72) Inventor: Anthony Santarelli, North Olmsted, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 17/158,378

(22) Filed: Jan. 26, 2021

(65) Prior Publication Data

US 2021/0228001 A1 Jul. 29, 2021

Related U.S. Application Data

(60) Provisional application No. 62/966,692, filed on Jan. 28, 2020.

(51) Int. Cl.

| | |
|---|---|
| ***A47F 7/14*** | (2006.01) |
| ***A47B 45/00*** | (2006.01) |
| ***A47F 7/00*** | (2006.01) |
| ***A47F 5/00*** | (2006.01) |

(52) U.S. Cl.

CPC ..... *A47F 7/143* (2013.01); *A47B 45/00* (2013.01); *A47F 5/0068* (2013.01); *A47F 7/0042* (2013.01); *A47F 7/142* (2013.01); *A47F 7/145* (2013.01); *A47F 7/147* (2013.01)

(58) Field of Classification Search

CPC ..... A47F 7/143; A47F 7/142; A47F 7/145; A47F 7/0042; A47F 7/0014; A47F 5/16; A47F 7/144; A47F 7/147; A47F 7/163; A47F 2005/165; A47F 5/0062; A47F 5/0006; A47F 5/0838; A47F 5/0068; A47F 5/0876; G09F 5/04; G09F 5/02; G09F 1/10; G09F 1/103; G09F 3/204; B42F 17/02; A47G 1/1646; A47G 29/00; A47B 21/03; A47B 220/0016; A47B 96/028; A47B 19/04; A47B 65/10; A47B 45/00; A47B 96/025; A47B 23/043; A47B 23/02; A47B 23/042; A47B 2200/0016

USPC ..... 211/50, 175, 75, 119.003, 52, 55, 49.1, 211/41.7, 119.012, 88.02, 94.01, 128.1, 211/126.13, 126.16, 133.6; 248/241, (Continued)

(56) References Cited

U.S. PATENT DOCUMENTS 1,515,058 A * 11/1924 Lindhe ..... A47B 21/045 211/50
1,542,495 A * 6/1925 Ebert ..... A47B 21/045 211/51

(Continued)

FOREIGN PATENT DOCUMENTS

| | | |
|---|---|---|
| GB | 2454086 | 4/2009 |
| WO | 9942981 | 8/1999 |
| WO | 0024297 | 5/2000 |

*Primary Examiner* — Jennifer E. Novosad
(74) *Attorney, Agent, or Firm* — Christine Flanagan

(57) ABSTRACT

A greeting card displayer having a vertical portion and a horizontal portion perpendicular to the vertical portion, a hook which is attached to the vertical portion of the display, and an insert panel which has a greeting card attached thereto and gets inserted onto the display. The displayer is operative to be inserted onto (over card retainer of) a greeting card display and to highlight specific cards, such as, for example, pop-up greeting cards.

13 Claims, 4 Drawing Sheets

(58) Field of Classification Search
USPC ..... 248/441.1, 447.1, 448, 447.2, 450, 248/451–453; 108/65, 67, 102
See application file for complete search history.

(56) References Cited

U.S. PATENT DOCUMENTS 1,651,471 A * 12/1927 Sawyer ..... G09F 3/20 248/448
1,997,829 A * 4/1935 McKee ..... A47F 7/143 211/55
2,144,534 A * 1/1939 Hedquist ..... A47B 45/00 211/88.01
2,538,318 A * 1/1951 Mitchell ..... B41J 29/15 248/448
2,620,082 A * 12/1952 Harmon ..... A47F 5/0068 220/8
2,639,040 A * 5/1953 Tapley ..... A47F 5/0068 211/119.003
2,827,718 A * 3/1958 Howard ..... G09F 3/20 40/658
3,129,819 A * 4/1964 Chandler ..... B65B 27/083 211/50
3,198,340 A * 8/1965 Tokash ..... A47F 7/145 211/49.1
3,221,676 A * 12/1965 Sedo ..... A47B 45/00 108/28
3,248,765 A 5/1966 Achabal et al.
3,304,042 A * 2/1967 Ivandick ..... A47F 7/147 248/314
3,341,166 A * 9/1967 Forrester ..... A47B 23/004 248/448
3,351,312 A * 11/1967 Ballas ..... A47B 23/007 248/448
3,497,882 A * 3/1970 Weeks ..... A47B 23/007 482/148
3,598,247 A * 8/1971 Papers ..... A45B 3/00 211/50
3,693,926 A 9/1972 Carter
3,850,303 A * 11/1974 Franklin ..... A47B 45/00 211/134
3,897,037 A * 7/1975 Johnson ..... A47F 7/142 248/460
3,949,880 A * 4/1976 Fortunato ..... A47F 5/0068 211/119.003
4,036,369 A * 7/1977 Eisenberg ..... A47B 45/00 211/88.02
4,073,384 A * 2/1978 Celeste ..... A47B 96/027 211/134
4,094,416 A * 6/1978 Smith ..... A47B 45/00 211/85.28
4,130,203 A * 12/1978 Russell, III ..... B42F 17/08 211/126.1
4,155,312 A * 5/1979 Thorkildson ..... A47B 45/00 108/102
4,215,840 A * 8/1980 Babberl ..... A47F 5/0068 248/214
4,312,490 A * 1/1982 Biasini ..... A47B 19/002 248/441.1
4,372,518 A * 2/1983 Biasini ..... A47B 19/002 248/441.1
4,429,850 A 2/1984 Weber et al.
4,441,433 A 4/1984 Caldwell
4,460,145 A * 7/1984 Ando ..... A47B 46/00 108/140
D281,551 S * 12/1985 Wallace ..... D6/310
4,611,720 A * 9/1986 Staab ..... A47F 7/0021 211/184
4,613,047 A * 9/1986 Bushyhead ..... A47F 7/145 108/101
4,802,595 A * 2/1989 Northington ..... A47B 13/00 108/26
4,817,900 A * 4/1989 Whittington ..... A47B 57/585 211/162
4,828,121 A * 5/1989 Willcocks, Jr. ..... A47F 5/0068 211/126.1
4,872,567 A 10/1989 Bustos
4,896,779 A * 1/1990 Jureckson ..... A47F 5/005 211/184
4,938,365 A * 7/1990 Conway ..... A47B 45/00 211/175
D317,220 S * 5/1991 Diamond ..... D3/305
5,150,813 A * 9/1992 Harris ..... A47F 7/147 206/45.26
5,184,737 A * 2/1993 Hardy ..... A47F 7/147 211/55
5,222,609 A * 6/1993 Eaton ..... A47F 7/147 211/55
5,232,104 A * 8/1993 Francois ..... A47F 5/0068 108/28
5,272,826 A 12/1993 Gingras
5,295,596 A * 3/1994 Squitieri ..... A47F 5/0068 211/175
5,312,001 A * 5/1994 Sorensen ..... G09F 1/12 211/50
5,317,977 A * 6/1994 Omessi ..... A47B 17/033 108/108
5,356,109 A * 10/1994 Biasini ..... A47B 19/002 248/441.1
5,580,024 A * 12/1996 Briee ..... A47B 23/043 248/444
5,613,606 A * 3/1997 Meyer ..... B07C 7/04 206/449
5,720,396 A * 2/1998 Wegscheid ..... A47F 7/145 211/55
6,116,433 A * 9/2000 Pursall ..... A47F 7/145 211/55
6,119,990 A * 9/2000 Kump ..... A47F 5/0068 211/57.1
6,126,125 A * 10/2000 Dalton ..... G09F 3/204 248/205.2
6,170,674 B1 * 1/2001 Caterinacci ..... A47F 7/0042 211/41.1
6,240,857 B1 6/2001 Elizer
6,378,709 B1 4/2002 Stuart
6,412,648 B1 * 7/2002 Woolnough ..... A47F 7/145 211/128.1
6,422,403 B1 * 7/2002 Woolnough ..... A47F 7/145 211/130.1
6,454,106 B1 * 9/2002 Howard ..... A47B 45/00 211/43
6,530,485 B1 * 3/2003 Weber ..... A47F 7/145 211/128.1
D510,603 S * 10/2005 Lowry ..... D20/44
6,951,290 B2 10/2005 Speed
7,028,851 B1 * 4/2006 Fenger ..... A47B 96/027 211/40
7,775,379 B2 * 8/2010 Hodge ..... A47F 5/0846 211/55
7,882,969 B2 * 2/2011 Gerstner ..... A47F 5/16 211/119.003
7,987,998 B1 * 8/2011 Belk ..... A47F 7/145 211/55
8,042,700 B1 10/2011 Smalley
8,096,426 B2 * 1/2012 Vivas ..... B42F 7/12 211/55
8,136,677 B2 * 3/2012 Brozak ..... G09F 1/10 211/50
8,469,220 B2 * 6/2013 Van Fleet ..... G01G 19/4144 220/482
8,561,816 B2 * 10/2013 Martin ..... A47F 7/147 211/50
8,800,946 B2 8/2014 Valiulis
10,702,078 B1 * 7/2020 Walker ..... G09F 3/208
2003/0029819 A1 * 2/2003 Pavlic ..... E05G 1/00 211/86.01
2005/0139560 A1 * 6/2005 Whiteside ..... A47B 57/586 211/119.003
2005/0263473 A1 * 12/2005 TenBrink ..... A47B 45/00 211/189

(56) References Cited

U.S. PATENT DOCUMENTS

| | | | | |
|---|---|---|---|---|
| 2012/0305438 | A1* | 12/2012 | Kao | B25H 3/04 206/525 |
| 2014/0021315 | A1* | 1/2014 | Johnson | A47B 96/07 248/276.1 |
| 2014/0054250 | A1* | 2/2014 | Brozak | A47F 7/145 211/85.26 |
| 2014/0158846 | A1* | 6/2014 | Nicolis | G09F 3/204 248/309.1 |
| 2015/0359336 | A1* | 12/2015 | Henn | A47B 96/02 211/132.1 |
| 2017/0095093 | A1* | 4/2017 | Brenner | A47F 3/0426 |
| 2017/0116892 | A1 | 4/2017 | Garfinkle | |
| 2018/0216874 | A1* | 8/2018 | Pinheiro | F25D 23/028 |
| 2021/0228001 | A1* | 7/2021 | Santarelli | A47F 7/145 |

* cited by examiner

GREETING CARD DISPLAYER

RELATED APPLICATIONS

This application is a non-provisional of and claims priority to U.S. Provisional Patent Application No. 62/966,692, which was filed on Jan. 28, 2020, a copy of which is incorporated herein by reference in its entirety.

FIELD OF THE INVENTION

This invention is in the field of retail fixtures for displaying social expression products, such as greeting cards.

SUMMARY OF THE INVENTION

In one embodiment, the present disclosure and related inventions describe a greeting card displayer having a vertical portion, a horizontal portion contiguous with and perpendicular to the vertical portion, each of the vertical and horizontal portions having a channel at each distal end thereof, a hook which is contiguous with and extends outward from an outer surface of the vertical portion of the display and an insert panel which is inserted between the channels at the distal ends of the vertical and horizontal portion, the insert panel operative to have a greeting card secured thereto.

In another embodiment, the greeting card displayer includes an 1-shaped body with a vertical portion and a horizontal portion perpendicular to the vertical portion, the vertical and horizontal portions creating a 90-degree angle therebetween, a hook attached to an outer surface of the vertical portion of the 1-shaped body, a first channel located at one end of the vertical portion of the 1-shaped body and a second channel located at one end of the horizontal portion of the 1-shaped body and an 1-shaped insert panel which is inserted over an inner surface of the vertical and horizontal portions of the 1-shaped body and which is held in place by the first and second channels.

In still another embodiment, a greeting card displayer contains a body having a vertical portion and a horizontal portion perpendicular to the vertical portion, creating a substantially 1-shaped body, a first channel at a distal end of the vertical portion of the body, a second channel at a distal end of the horizontal portion of the body, an insert panel having a vertical portion and a horizontal portion perpendicular to the vertical portion, creating a substantially 1-shaped insert panel, and an upside-down u-shaped channel located on a rear surface of the vertical portion of the body.

DETAILED DESCRIPTION OF PREFERRED AND ALTERNATE EMBODIMENTS

The greeting card display (hereinafter referred to as "the displayer") 10 of the present disclosure and related inventions displays and highlights cards 12 and can be attached to a card retainer on a variety of different greeting card fixtures 14. The displayer 10 can accommodate the presentation of a variety of different greeting cards 12 by allowing for different insert panels 16.

Figure 2:
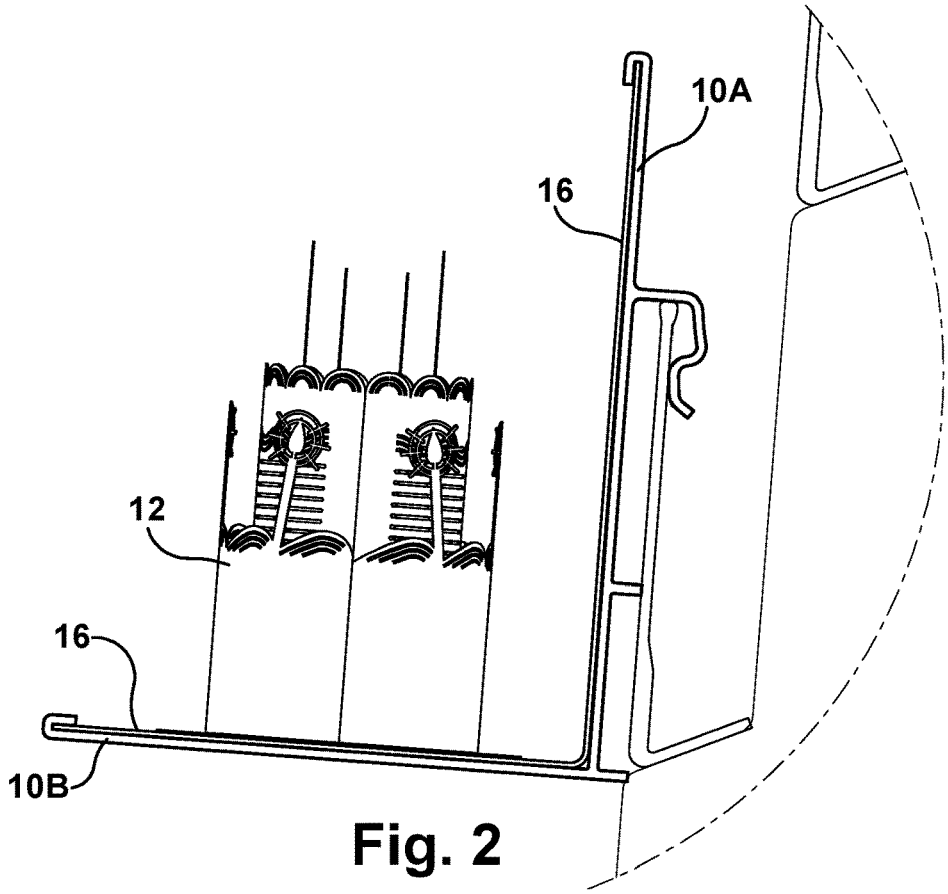
FIG. 2 is a right side view thereof.
Figure 3:
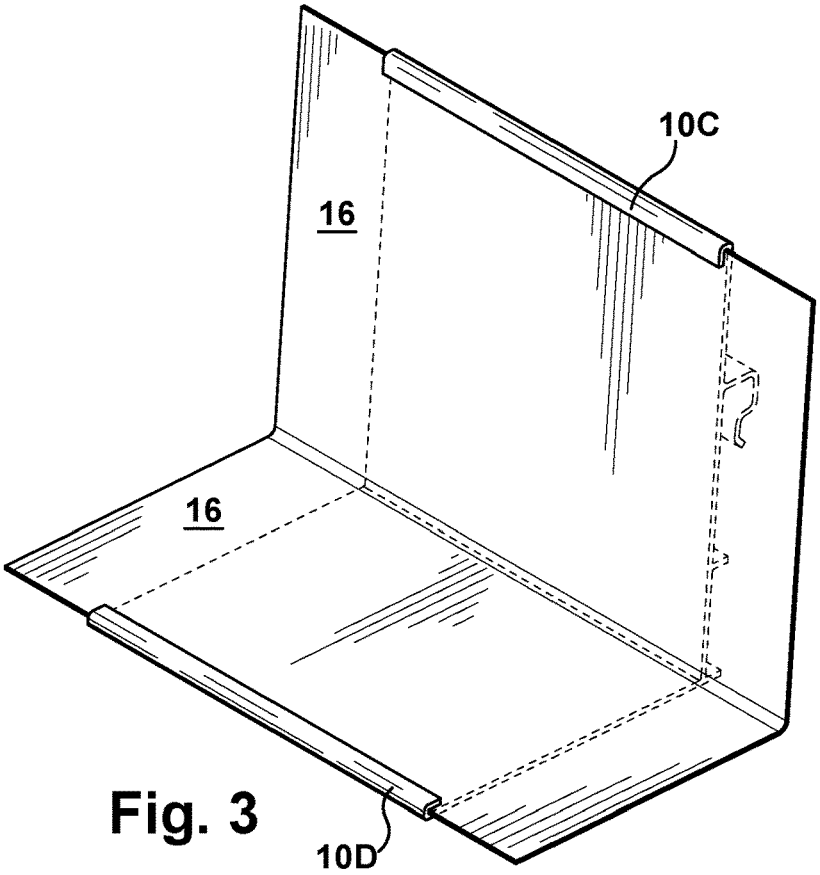
FIG. 3 is a perspective view thereof.
Figure 4:
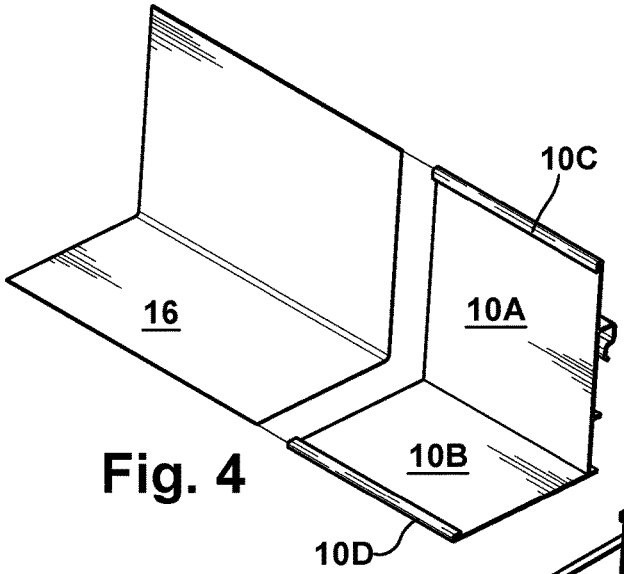
FIG. 4 is a front right side perspective view thereof with greeting card removed therefrom.
Figure 5:
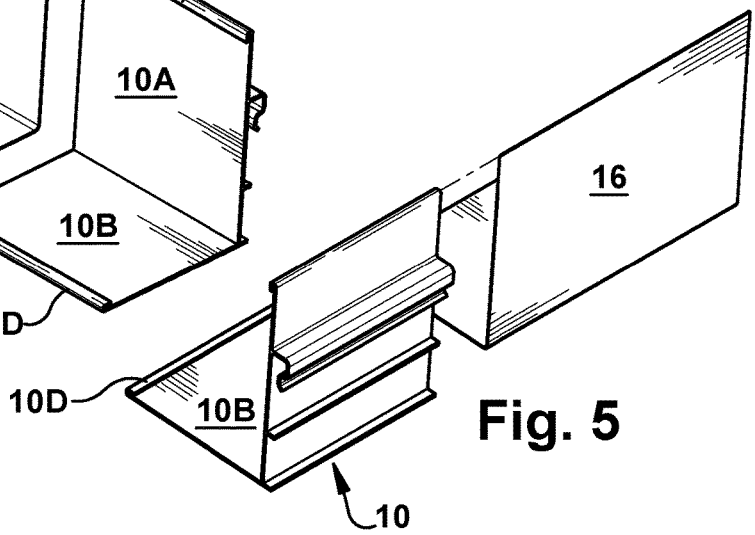
FIG. 5 is a rear right side perspective view thereof with greeting card removed therefrom.
Figure 6:
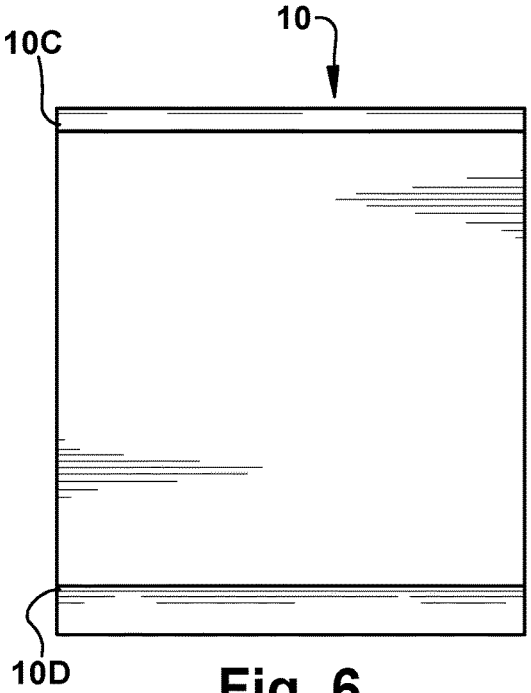
FIG. 6 is a front elevation view thereof.
Figure 7:
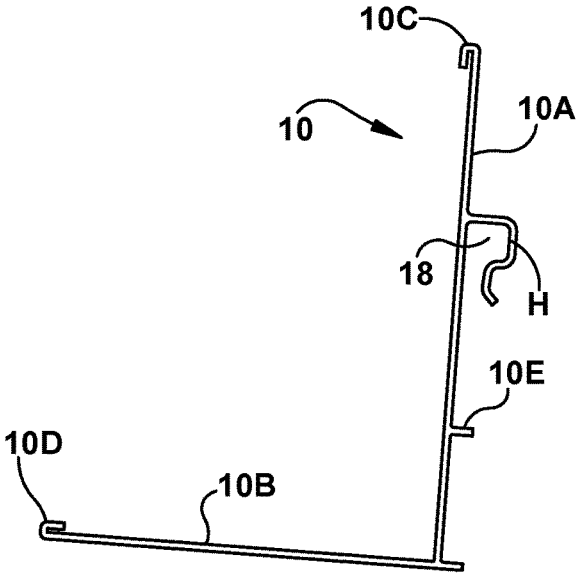
FIG. 7 is a right side elevation view thereof.
Figure 8:
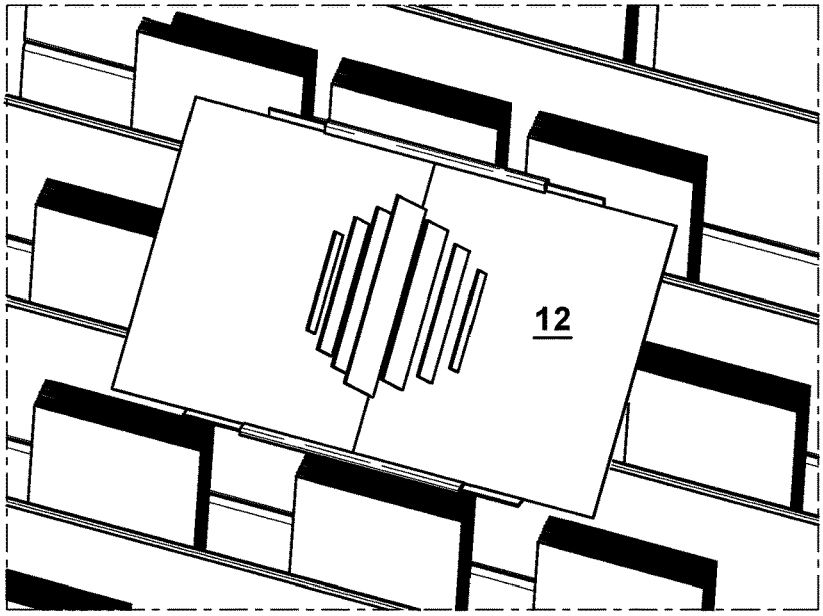
FIG. 8 is a front perspective view of the GREETING CARD DISPLAYER of the present invention attached to a greeting card display fixture with a greeting card inserted therein.

The displayer 10 has an L-shape with a first or vertical portion 10A and a second or horizontal portion 10B contiguous with and perpendicular to the first or vertical portion 10A. Each of the first and second portions 10A, 10B of the displayer have a first end and a second end. The first and second portions connect at the first end, forming a 90-degree angle. There is a small u-shaped channel at each distal (or second) end 10C, 10D of the first and second portions 10A, 10B. These channels 10C, 10D are used to hold an insert panel 16 in place on the displayer 10. In one embodiment, the first or vertical portion 10A of the displayer 10 is approximately 6-inches long and the second or horizontal portion 10B of the displayer 10 is approximately 4.5-inches long. The second panel 10B extends past the connection point with the first panel 10A approximately 0.25-inches, as can be seen in FIG. 7. There is also a small notch 10E extending outward and perpendicularly from the first panel 10A at approximately 1.5-inches from the first end of the first panel 10A (connection point with the second panel). In one embodiment, the width of the space between the u-shaped channels 10C, 10D located at each second end of the first and second panels 10A, 10B of the displayer 10 is approximately 0.063-inches. A hook H is attached to an outer surface of the first or vertical panel 10A in an upper portion thereof, as shown in FIGS. 2, 5 and 7. The hook H, in one embodiment, is contiguous with the first panel 10A of the displayer 10. In other embodiments, the hook H may be a separate element which is attached to the displayer 10. The hook H is located approximately 4-inches from the first end of the first panel 10A. The hook H extends outward from and perpendicular to the first panel 10A then continues downward (parallel to the first panel 10A) and then curves to the right, then to the left, creating a slightly curved section. The channel 18 created between the downward section of the hook H and the first panel 10A is approximately 0.5-inches. The space between the curved section of the hook H and the first panel 10A is approximately 0.25-inches. The hook H is designed to be flexible enough to cradle over and snap onto a card retainer (also referred to as a front card sham or front card wall) 20, which typically vary between 0.188-inches and 0.375-inches. The flexibility of the hook H allows the displayer 10 to be used (attached to) a variety of card tiers 20 and fixture lines. In one embodiment, the displayer 10 and hook H are made of extruded plastic, although other somewhat flexible materials can be used. While various dimensions have been given with respect to the displayer 10, these are given only for descriptive purposes in a particular embodiment. Various other dimensions may be used. These dimensions are not intended to limit the scope of the present invention in any way.

Figure 1:
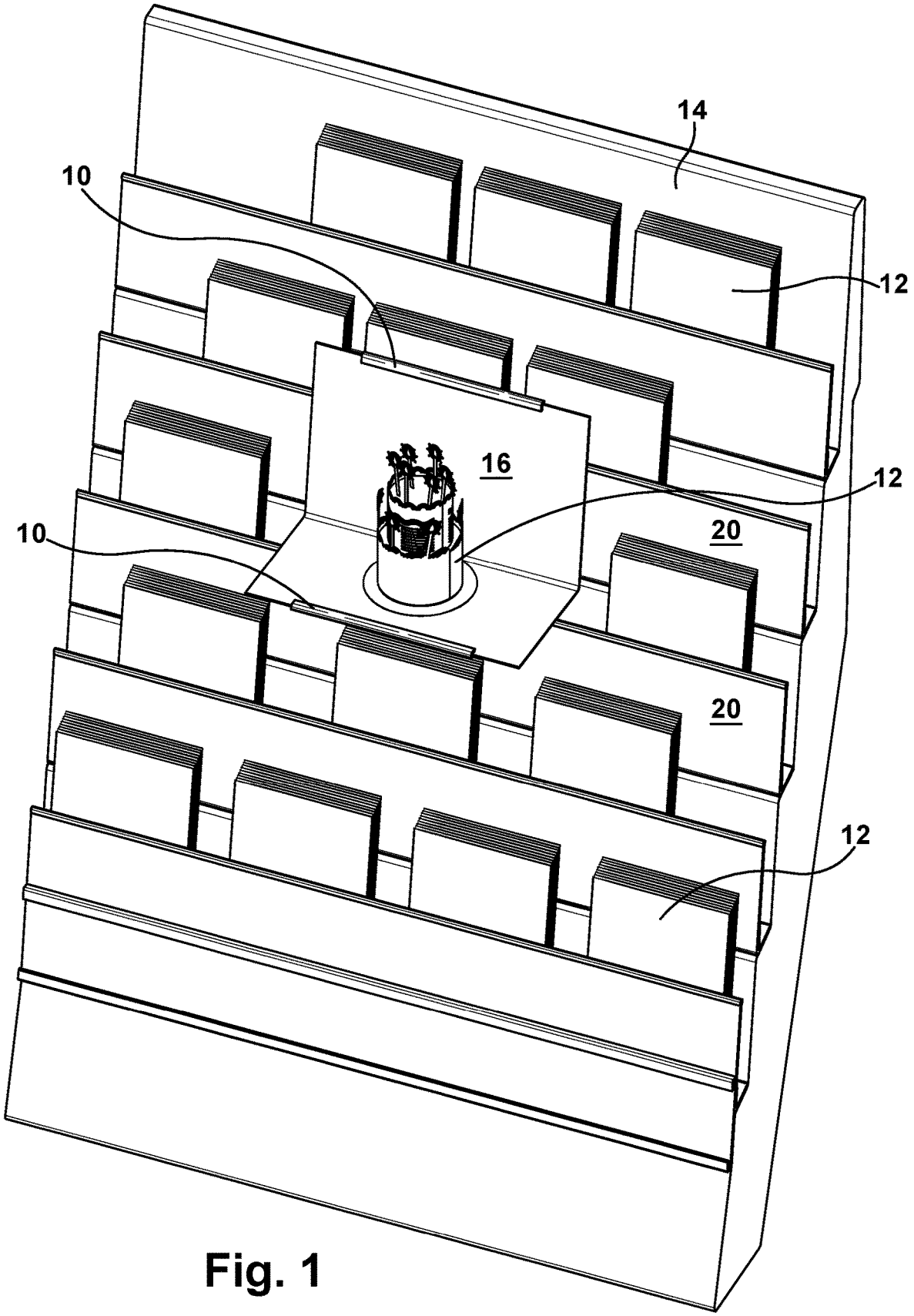
FIG. 1 is a front right side perspective view of the GREETING CARD DISPLAYER of the present invention attached to a greeting card display fixture and with a greeting card inserted therein.
Figure 9:
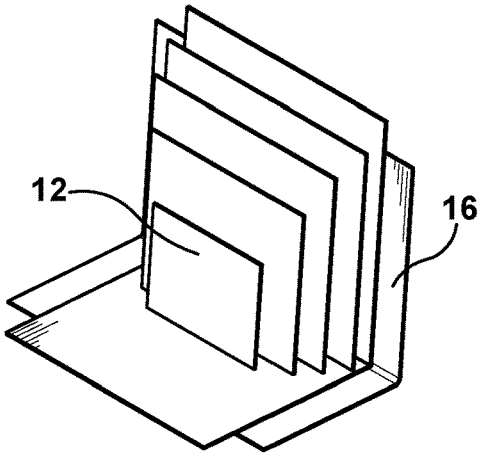
FIGS. 9-11 are front perspective views of the GREETING CARD DISPLAYER with various pop-up cards inserted therein.
Figure 10:
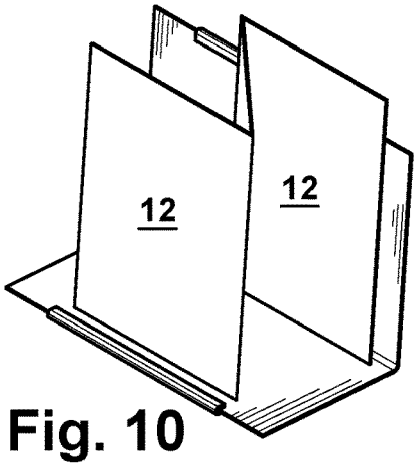
Figure 11:
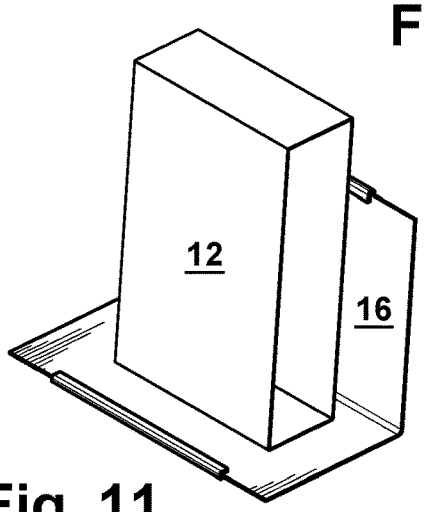

The displayer 10 of the present disclosure and related inventions is particularly useful for displaying pop-up or three-dimensional cards at retail. Typically, these cards must be removed from the card tier and opened to view the inside of the card and the pop-up structure. The displayer 10 facilitates the display of these hard-to-display greeting cards at retail. To display a greeting card 12 upon the displayer 10, the greeting card 12 must first be attached to an insert panel 16. The insert panels 16 are sized to be able to fit within the channels 10C, 10D at the second ends of the first and second panels 10A, 10B of the displayer 10 and also thick enough to create a friction fit within the channel 10C, 10D to avoid the insert panel 16 from inadvertently being removed from the channels 10C, 10D. The insert panels 16 may be of different widths, depending on the type of greeting card 12 displayed, how the greeting card 12 is staged with regard to presentation, and how the greeting card 12 functions. For example, a pop-up greeting card 12 may be fully opened and attached to the insert panel 16 (along the second or horizontal display panel 10B), as shown in FIGS. 1, 2 and 11. In another example, a 90-degree pop-up card 12 may be opened at a 90-degree angle such that the one greeting card panel is attached to the insert panel (along the first or vertical portion of the display) 10A and the other greeting card panel is attached to the insert panel (along the second or horizontal portion of the displayer) 10B, as shown in FIG. 9. The insert panels 16 may also be used to display verbiage, advertising, or graphical elements.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card displayer comprising:

an L-shaped body having a vertical portion, and a horizontal portion contiguous with and forming a 90-degree angle with respect to the vertical portion, each of the vertical and horizontal portions having a channel at each distal end, opposite the 90-degree angle, the channel running the entire length of the vertical and horizontal portions of the L-shaped body;

a hook which is contiguous with and extends outward from an outer surface of the vertical portion of the L-shaped body; and an L-shaped insert panel having a vertical panel and a horizontal panel contiguous with and perpendicular to the vertical panel, wherein a portion of the vertical panel is inserted into the channel at the distal end of the vertical portion of L-shaped body and a portion of the horizontal panel is inserted into the channel at the distal end of the horizontal portion of the L-shaped body;

wherein the L-shaped insert panel is operative to have a greeting card secured thereto.

2. The greeting card displayer of claim 1, wherein the hook is operative to clip onto the front panel of a greeting card tier.

3. The greeting card displayer of claim 1, wherein the insert panel is interchangeable.

4. The greeting card displayer of claim 1, wherein the insert panel can be used for advertising or graphical elements.

5. A greeting card displayer comprising:

an L-shaped body with a vertical portion and a horizontal portion perpendicular to the vertical portion, the vertical and horizontal portions creating a 90-degree angle therebetween;

a hook attached to an outer surface of the vertical portion of the L-shaped body;

a first channel located at one end of and spanning the entire length of the vertical portion of the L-shaped body and a second channel located at one end of and spanning the entire length of the horizontal portion of the L-shaped body;

an L-shaped insert panel which is inserted over an inner surface of the vertical and horizontal portions of the L-shaped body and which is held in place by the first and second channels;

wherein the horizontal portion of the L-shaped body is longer than the vertical portion.

6. The greeting card displayer of claim 5, wherein the hook is operative to be placed over a front sham of a greeting card row.

7. The greeting card displayer of claim 5, wherein the L-shaped insert panel is interchangeable.

8. The greeting card displayer of claim 5 further comprising a notch attached to the outer surface of the vertical portion of the L-shaped body.

9. The greeting card displayer of claim 5, wherein the hook is contiguous with the vertical portion of the L-shaped body.

10. A greeting card displayer comprising:

a body having a vertical portion and a horizontal portion perpendicular to the vertical portion, creating a substantially L-shaped body;

a first channel located on and running the entire length of the horizontal portion of the body opposite an intersection between the horizontal and vertical portion of the body;

a second channel located on and running the entire length of the vertical portion of the body opposite the intersection between the vertical and horizontal portion of the body;

an insert panel having a vertical portion and a horizontal portion perpendicular to the vertical portion, creating a substantially L-shaped insert panel;

wherein the horizontal portion of the insert panel is inserted into the first channel and the vertical portion of the insert panel is inserted into the second channel;

an upside-down U-shaped channel located on a rear surface of the vertical portion of the body.

11. The greeting card displayer of claim 10, wherein the insert panel is operative to have a greeting card attached thereto.

12. The greeting card displayer of claim 10, further comprising an upside-down U-shaped channel located on a rear surface of the vertical portion of the body that is operative to be attached to a front panel of a greeting card tier.

13. The greeting card displayer of claim 10, wherein the insert panel is interchangeable.

* * * * *